US010516926B2

(12) United States Patent
Kamihara et al.

(10) Patent No.: US 10,516,926 B2
(45) Date of Patent: Dec. 24, 2019

(54) SPEAKER UNIT MOUNTING BRACKET, AND INSTALLATION SPEAKER USING THE SAME

(71) Applicant: YAMAHA CORPORATION, Hamamatsu-shi (JP)

(72) Inventors: Masanori Kamihara, Hudson, MA (US); Masao Yoshida, Hamamatsu (JP); Shotaro Kondo, Hamamatsu (JP); Katsutoki Hanayama, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/961,253

(22) Filed: Apr. 24, 2018

(65) Prior Publication Data

US 2018/0242062 A1 Aug. 23, 2018

Related U.S. Application Data

(63) Continuation of application No. PCT/JP2016/080164, filed on Oct. 12, 2016.

(30) Foreign Application Priority Data

Oct. 28, 2015 (JP) ..... 2015-211637

(51) Int. Cl.
*H04R 1/02* (2006.01)
*H04R 1/32* (2006.01)
*H04R 3/00* (2006.01)

(52) U.S. Cl.
CPC ..... *H04R 1/026* (2013.01); *H04R 1/323* (2013.01); *H04R 3/00* (2013.01)

(58) Field of Classification Search
CPC ..... H04R 1/02; H04R 1/025; H04R 1/026; H04R 2201/025
USPC ..... 381/387, 386
See application file for complete search history.

(56) References Cited

U.S. PATENT DOCUMENTS 7,369,672 B2 * 5/2008 Hirschhorn ..... F16M 11/041 248/917
2012/0275631 A1 * 11/2012 Caldes ..... H04R 1/028 381/333
2013/0327912 A1 12/2013 Yoshida et al.
2013/0329929 A1 * 12/2013 Yoshida ..... H04R 1/02 381/334

FOREIGN PATENT DOCUMENTS

JP S55121571 U1 8/1980
JP 2013258531 A 12/2013

OTHER PUBLICATIONS

International Search Report issued in Intl. Appln No. PCT/JP2016/080164 dated Nov. 8, 2016. English translation provided.

(Continued)

*Primary Examiner* — Alexander Krzystan
(74) *Attorney, Agent, or Firm* — Rossi, Kimms & McDowell LLP

(57) ABSTRACT

An object is to reduce weight load acting on a connecting member that connects a speaker unit and a bracket and keep the weight balance of the right and left of the speaker unit. A speaker unit mounting bracket is provided with a voltage converter, a base plate, and a cover. The cover covers the voltage converter and the base plate.

5 Claims, 7 Drawing Sheets

(56) References Cited

OTHER PUBLICATIONS

Written Opinion issued in Intl. Appln. No. PCT/JP2016/080164 dated Nov. 8, 2016.
"Surface Mount Speaker VXS8/VXS8W/VXS5/VXS5W, Owner's Manual." Mar. 2015. Yamaha Corporation.
Office Action issued in Chinese Appln. No. 201680063237.1 dated Mar. 22, 2019. English machine translation provided.
Office Action issued in Japanese Appln No. 2015-211637 dated Oct. 2, 2019. English translation provided.
Office Action issued in Chinese Appln. No. 201680063237.1 dated Sep. 2, 2019. English translation provided.

* cited by examiner

SPEAKER UNIT MOUNTING BRACKET, AND INSTALLATION SPEAKER USING THE SAME

CROSS REFERENCE TO RELATED APPLICATIONS

The present application is a continuation application of International Patent Application No. PCT/JP2016/080164, filed on Oct. 12, 2016, which claims priority to Japanese Patent Application No. 2015-211637, filed on Oct. 28, 2015. The contents of these applications are incorporated herein by reference in their entirety.

BACKGROUND OF THE INVENTION

1. Field of the Invention

Preferred embodiments of the present invention relates to a bracket used when a speaker unit is mounted on a wall or ceiling and to an installation speaker using such a bracket.

2. Description of the Related Art

A surface-mount speaker is a type of an installation speaker, and is a (broadly defined) speaker of a type to be mounted on a wall or a ceiling. Conventionally, in a case in which the surface-mount speaker is mounted on a wall or a ceiling, a bracket has been fixed to the wall or the ceiling and a speaker unit has been mounted to the bracket through a connecting member. It is to be noted that "the speaker unit" in the present invention indicates a housing portion incorporating a narrowly defined speaker being a sounding body, that is, a body portion of the surface-mount speaker. In addition, "the bracket" indicates a member that is fixed to a wall or a ceiling by a method such as screwing to mount a speaker unit through a connecting member.

SUMMARY OF THE INVENTION

The speaker unit of the conventional surface-mount speaker stated above is provided with a voltage converter (matching transformer) in order to provide a so-called high impedance drive and the like in addition to the speaker narrowly defined as a sounding body in the housing. Therefore, the weight of the speaker unit has become heavy and has applied a large load to a connecting member between brackets.

In addition, for design, it is difficult to arrange a transformer at the center between the right and the left of the speaker unit, which has caused a problem that the weight balance between the right and the left of the speaker unit is lost.

One aspect of the present invention is a speaker unit mounting bracket that can reduce a weight load acting on a connecting member that connects a speaker unit and the speaker unit mounting bracket and keep the weight balance of the right and left of the speaker unit.

The speaker unit mounting bracket is provided with a voltage converter, a base plate, and a cover. The cover covers the voltage converter and the base plate.

Preferred embodiments of the present invention, since the voltage converter with a heavy weight is arranged inside the speaker unit mounting bracket, can reduce the weight of the speaker unit and a weight load acting on the connecting member.

The above and other elements, features, characteristics, and advantages of the present invention will become more apparent from the following detailed description of the preferred embodiments with reference to the attached drawings.

DETAILED DESCRIPTION

Figure 1A:
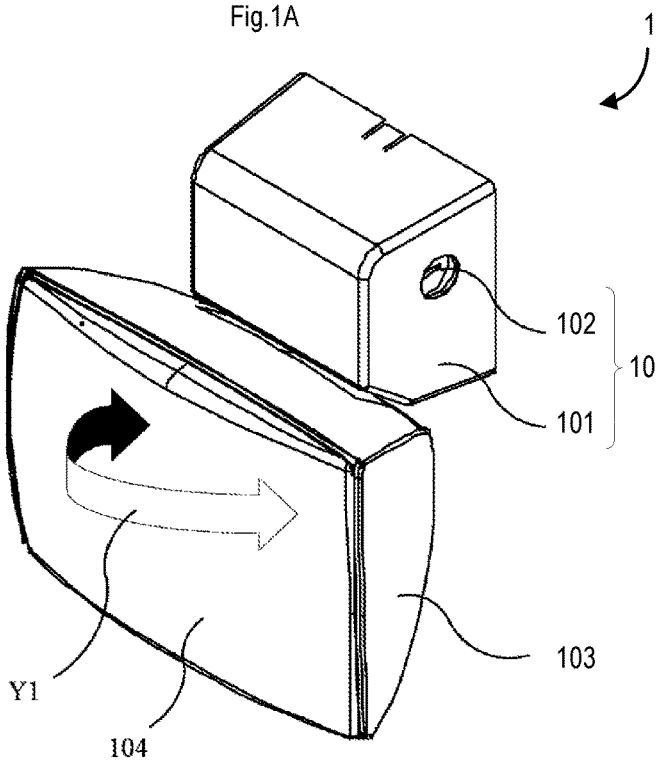
FIG. 1A is a perspective view of a speaker unit and a bracket.
Figure 1B:
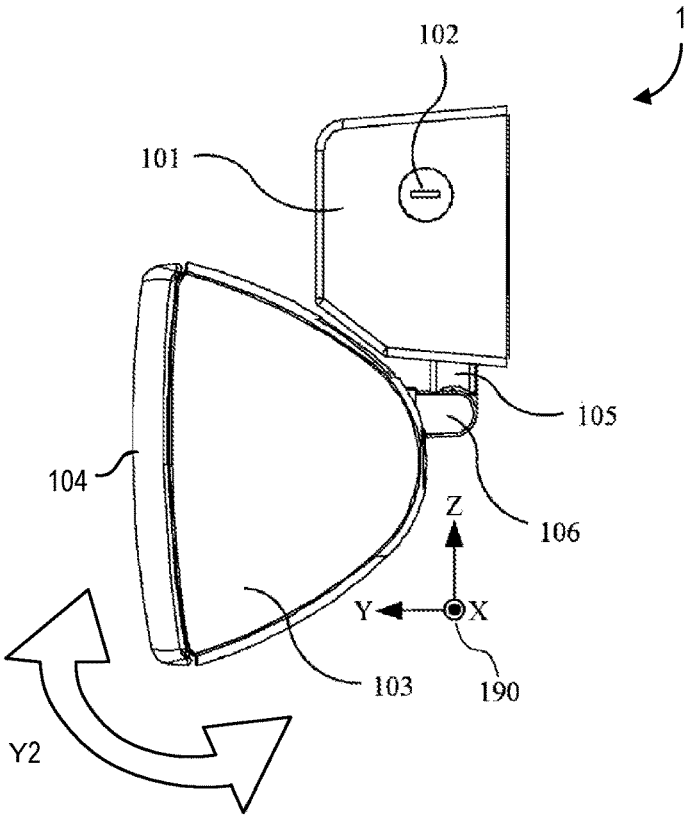
FIG. 1B is a side view of a speaker unit and a bracket.
Figure 2A:
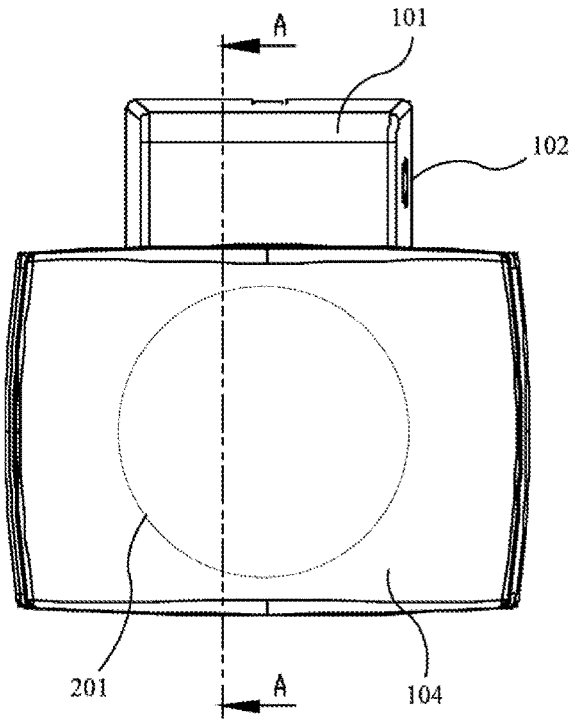
FIG. 2A is a front view of the speaker unit and the bracket.

FIG. 1A is a perspective view of a speaker unit and a bracket according to a preferred embodiment to which the present invention is applied, FIG. 1B is a right side view of the speaker unit and the bracket, and FIG. 2A is a front view of the speaker unit and the bracket. It is to be noted that, in each drawing to be described below, the same reference sign indicates the same component.

An installation speaker 1 is provided with a bracket 10 and a speaker unit 103. The bracket 10 is fixed to a wall, a ceiling, and the like, of a room. The bracket 10 includes a base plate 301 and a cover 101. The base plate 301 includes an impedance adjuster 402 for changing electric power supplied to a matching transformer 401 and a speaker, a connecting terminal 403, and other components. The matching transformer 401 is a voltage converter for a high impedance connection. The cover 101 is fixed to the base plate 301 so as to cover the base plate 301 in an arbitrary method.

A knob 102 is connected to the impedance adjuster 402 through the tip of a shaft arranged at the base plate of the bracket 10. The knob 102 is able to be rotatably operated with a slotted screwdriver, for example, from a hole bored in the cover 101. The speaker unit 103 is provided inside with a speaker being a sounding body.

It is to be noted that, since the bracket 10, if mountable, is able to be mounted in an arbitrary position in an arbitrary direction, absolute up-down and right-left directions are not determined and thus, for convenience in the present invention, a direction parallel to the Y axis of a coordinate axis 190 illustrated in FIG. 1B is defined as a front-rear direction, a direction parallel to the Z axis is defined as an up-down direction, and a direction parallel to the X axis is defined as a right-left direction.

A baffle for mounting a speaker in the speaker unit 103 includes an opening 201. The opening 201 includes a grill 104 that covers the opening 201. This grill 104 serves as the front face of the speaker unit 103.

As illustrated in FIG. 1B, the bracket 10 is provided with a first connecting member 105 and a second connecting member 106 that connect the bracket 10 and the speaker unit 103. One end of the first connecting member 105 is fixed to the base plate 301 of the bracket 10, and one end of the second connecting member 106 is fixed to the speaker unit 103. The bracket 10 and the speaker unit 103 are fixed when the first connecting member 105 and the second connecting member 106 are screwed.

The first connecting member 105 and the second connecting member 106 respectively correspond to a first axis member and a second axis member. The first connecting member 105 and the second connecting member 106 have a structure in which the first connecting member 105 and the second connecting member 106 are fixed to each other so as to rotate about each axis.

The first connecting member 105 sets the longitudinal direction (direction parallel to the Z axis) of the first connecting member 105 as a first axis and is fixed to the bracket 10 and the second connecting member 106 so as to rotate about the first axis. As a result, the speaker unit 103 is able to be fixed in an arbitrary position to the bracket 10 fixed to the wall or the like by being rotated in the right-left direction when viewed from the front side (the side of the grill 104 being the front face), in other words, as indicated with an arrow Y1 of FIG. 1A.

Further, the second connecting member 106, when being fixed to the first connecting member 105 with a screw 303 (see FIG. 3), is fixed so as to rotate about the axis of the screw (about the second axis parallel to the X axis). As a result, the speaker unit 103 is able to be fixed in an arbitrary position to the bracket 10 fixed to the wall or the like by being rotated in the up-down direction when viewed from the front side, in other words, as indicated with an arrow Y2 of FIG. 1B.

Figure 2B:
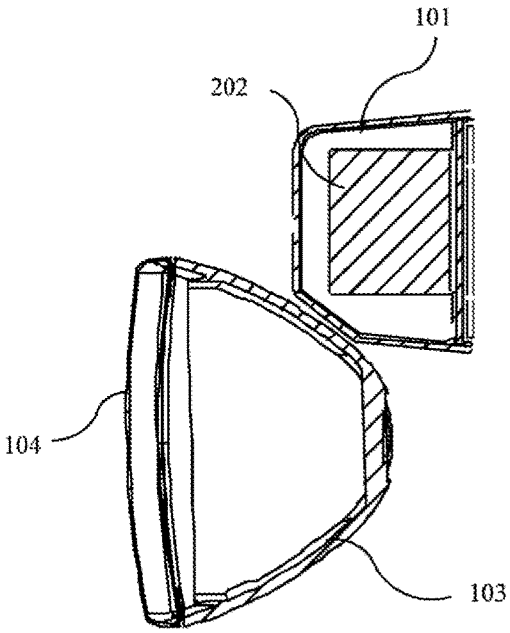
FIG. 2B is a sectional view of the speaker unit and the bracket.

FIG. 2B illustrates a cross-section taken along a line A-A of FIG. 2A. One of the features of the present preferred embodiment is that the matching transformer 401 usually arranged in the same housing (the speaker unit 103) as a speaker is arranged on the side of the bracket 10. As a result, since the matching transformer 401 is not arranged in the speaker unit 103, the weight of the speaker unit 103 becomes light. Therefore, the weight load of the first connecting member 105 and the second connecting member 106 is reduced.

Further, the main components that have a heavy weight in the speaker unit 103 may only be a speaker being a sounding body. Therefore, the speaker of the present embodiment is arranged in the center position in the right-left direction of the speaker unit 103. As a result, the weight balance on the right and left sides of the speaker unit 103 is maintained properly.

Figure 3:
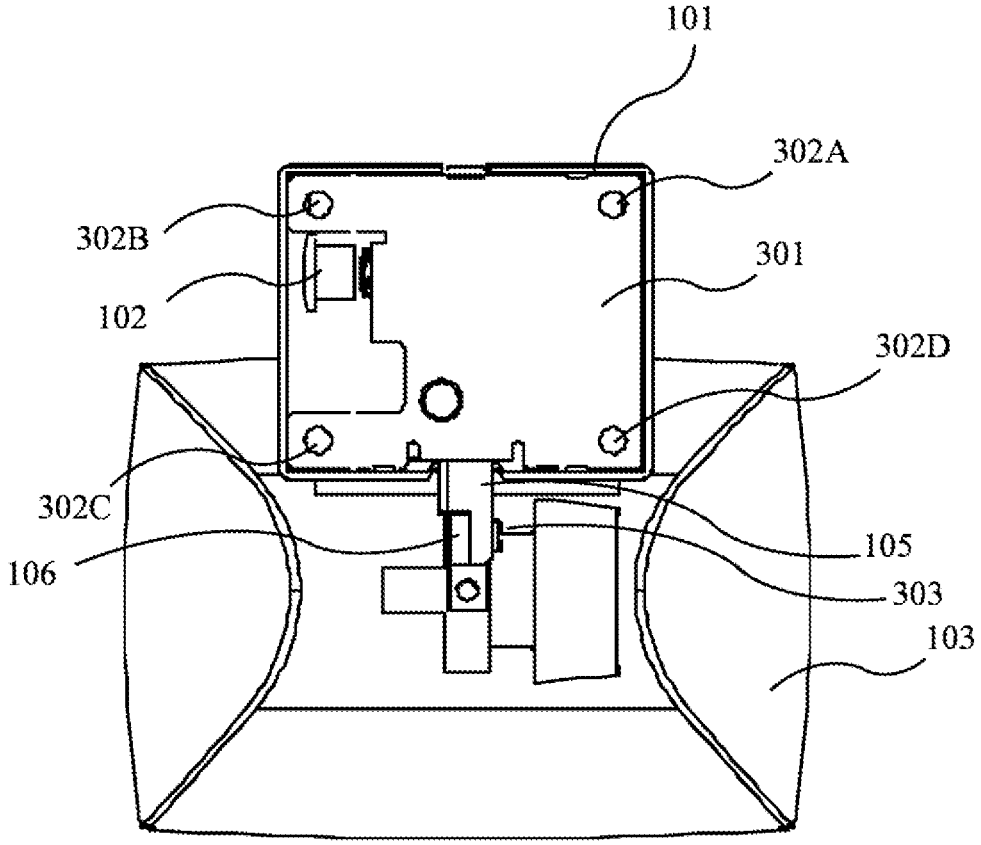
FIG. 3 is a rear view of the speaker unit and the bracket.

FIG. 3 is a rear view of the bracket 10 and the speaker unit 103. The base plate 301 includes four holes 302A to 302D for mounting the base plate 301 on a wall surface. The base plate 301 is fixed to a wall or the like when a screw passes through the holes 302A to 302D.

Figure 4A:
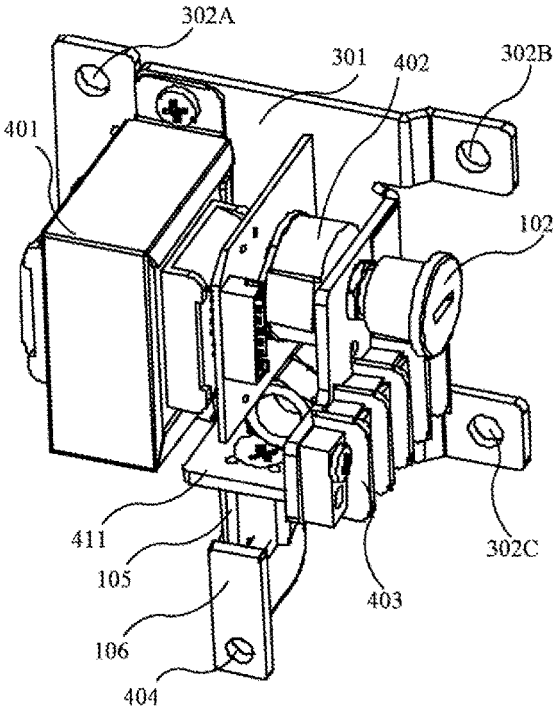
FIG. 4A is perspective view of a base plate in the bracket.
Figure 4B:
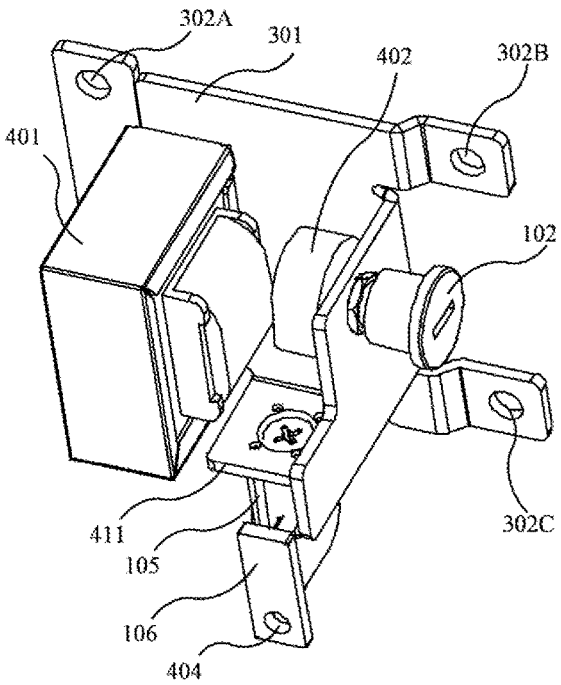
FIG. 4B is perspective view of a base plate in the bracket.

FIG. 4A is a perspective view of the base plate in the bracket 10. FIG. 4B is a perspective view in which some components have been removed from the base plate of FIG. 4A. The base plate 301 is provided with the matching transformer 401, the impedance adjuster 402, the connecting terminal 403, and other components.

The matching transformer 401 is a portion corresponding to a cross-section 202 of FIG. 2B. The knob 102 is mounted at the tip of a shaft of the impedance adjuster 402. As illustrated in FIG. 1, the knob 102 shows from the hole bored in the cover 101 of the bracket 10.

Figure 7A:
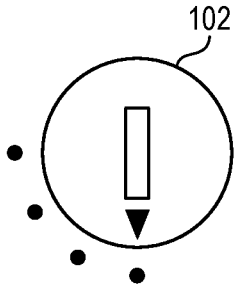
FIG. 7A is an enlarged view of a knob.
Figure 7B:
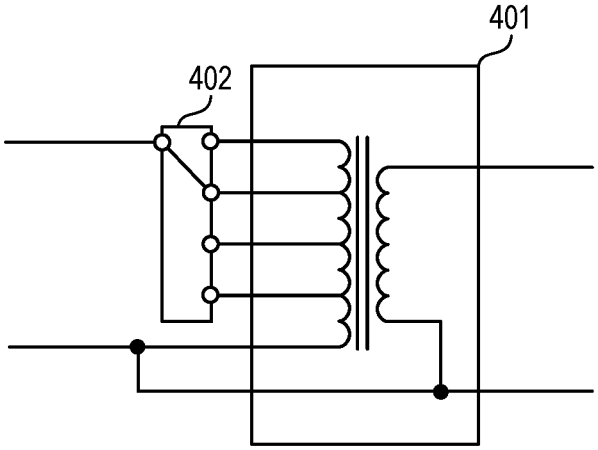
FIG. 7B is a circuit diagram of an impedance adjuster and a matching transformer.

FIG. 7A is an enlarged view of the knob 102, and FIG. 7B is a circuit diagram of the impedance adjuster 402 and the matching transformer 401. The knob 102, as illustrated in FIG. 7A, is switched over at a plurality of stages when a user rotates the knob by using a slotted screwdriver or a similar tool. As illustrated in FIG. 7B, the impedance adjuster 402 serves as a tap selector, and, when the knob 102 is rotated, a position at connecting to a primary side coil in the matching transformer 401 is changed. As a result, the number of windings of the primary side coil of the matching transformer 401 is changed, and impedance is changed. Therefore, the electric power supplied to a speaker is changed. It is to be noted that, while the present preferred embodiment illustrates a mode in which the number of windings of the primary side coil of the matching transformer 401 is changed, the impedance may be adjusted by changing a resistance value, for example.

The connecting terminal 403 has a line input terminal to which an output signal from an amplifier is input and an output terminal to be connected to the speaker in the speaker unit 103. It is to be noted that all electric wirings are omitted in the present preferred embodiment. At one end of the second connecting member 106, a hole 404 is bored. The second connecting member 106 is fixed to the speaker unit 103 when a screw passes through the hole 404.

Figure 5:
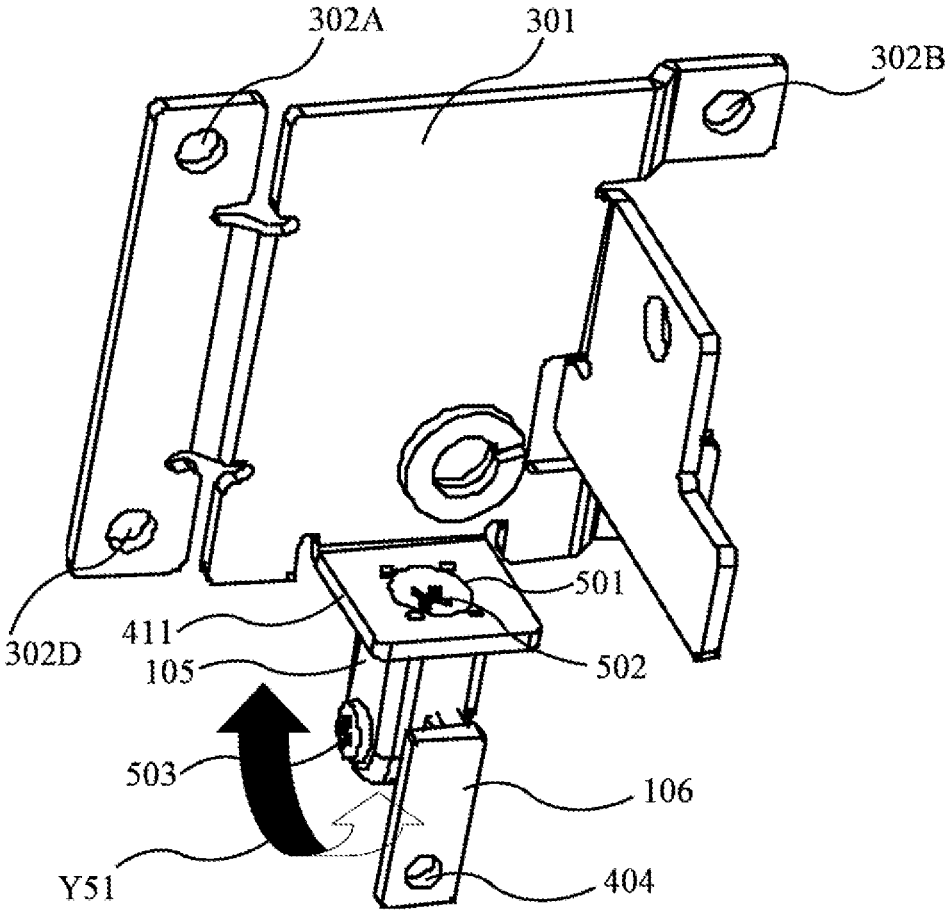
FIG. 5 is a perspective view of the base plate in the bracket.

FIG. 5 is a perspective view of the base plate 301. FIG. 5 is a diagram illustrating a state in which the matching transformer 401, the impedance adjuster 402, and the other components have been further removed from the base plate of FIG. 4B. An end portion on the lower side of the base plate 301 is a mounter 411 bent into an L-shaped cross-section. In the vicinity of the center of the mounter 411, a hole 501 is bored. The first connecting member 105 is fixed to the base plate 301 when a screw 502 is inserted into the hole 501.

Figure 6A:
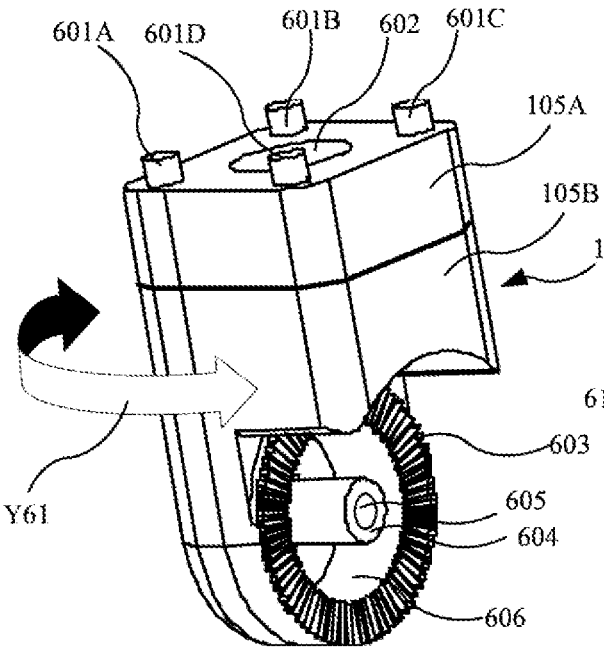
FIG. 6A is perspective view of first and second connecting members.
Figure 6B:
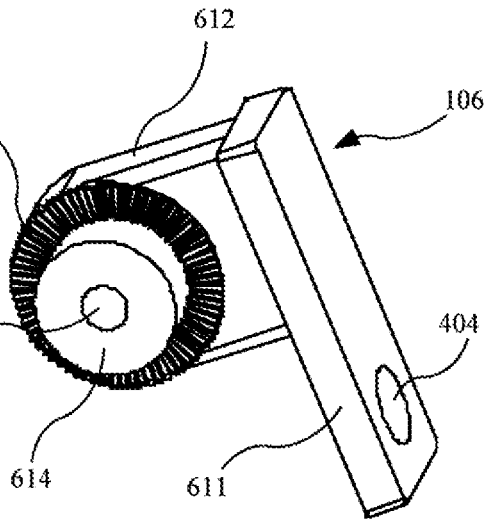
FIG. 6B is perspective views of first and second connecting members.

FIG. 6A is a perspective view of the first connecting member 105 and FIG. 6B is a perspective view of the second connecting member 106. The first connecting member 105 includes an upper member 105A and a lower member 105B that each have a substantially square pillar shape. The upper member 105A and the lower member 105B are rotatably fitted into each other as indicated with an arrow Y61. At an axis position of the square pillar shape of the upper member 105A and the lower member 105B, a hole 602 for screwing is bored. On the four corners of the upper surface of the upper member 105A, tabs 601A to 601D are provided. On the lower surface of the mounter 411 illustrated in FIG. 4 and FIG. 5, recess portions into which the tabs 601A to 601D are to be fitted are provided. The tabs 601A to 601D are fitted into the recess portions. In addition, with the screw 502, the upper member 105A and the lower member 105B are screwed to the mounter 411. The lower member 105B is rotated with respect to the upper member 105A as indicated with the arrow Y61, and, by being screwed in a predetermined rotation position, is able to perform positioning the speaker unit 103 in the right-left direction, as indicated with the arrow Y1 of FIG. 1.

On the side of the lower member 105B of the first connecting member 105, the side being opposite to the upper member 105A, a circular contact surface 603 is formed in such a manner as to be slightly shaved from the side surface. A cylinder 604 to be inserted to a hole 615 of the second connecting member 106 is provided in the central portion of the circular contact surface 603, and a hole 605 for screwing is formed in the central portion of the cylinder 604. A space between the circular contact surface 603 and the cylinder 604 is a hollow portion 606 to which a cylinder 614 of the second connecting member 106 to be described below is inserted. The second connecting member 106 includes a plate-like portion 611 and a U-shaped portion 612 provided on one surface of the tip of the plate-like portion 611. A circular contact surface 613 is formed on the internal surface of the U-shaped portion 612. A cylinder 614 to be inserted to the hollow portion 606 of the first connecting member 105 is provided on the inner side of the circular contact surface 613, and a hole 615 for screwing is formed in the central portion of the cylinder 614.

The cylinder 604 of the first connecting member 105 is inserted to the hole 615 of the second connecting member 106. The cylinder 614 of the second connecting member 106 is inserted to the hollow portion 606 of the first connecting member 105. The contact surface 603 and the contact surface 613 are in contact with each other, and, as illustrated in FIG. 5, are screwed with a screw 503. The contact surface 603 and the contact surface 613, since having been subjected to a surface roughening process for non-slip, are firmly fixed by being screwed. In addition, the second connecting member 106, as indicated with the arrow Y51 of FIG. 5, is rotated with respect to the first connecting member 105 and is screwed, so that the position in the up-down direction of the speaker unit 103 indicated with the arrow Y2 of FIG. 1 is determined. It is to be noted that, in place of a surface process, an engagement structure formed at each predetermined angle may be adopted for the contact surfaces 603 and 613. In such a case, a user can adjust the relative position of the first connecting member 105 and the second connecting member 106 at every predetermined angle.

It is to be noted that, while the above preferred embodiment has described an example in which the bracket 10 is fixed to a wall or the like with a screw, the bracket 10 may be embedded in a wall.

In addition, since, in the present preferred embodiment, the impedance adjuster 402 is arranged inside the bracket 10, the weight of the speaker unit 103 is further reduced. In such a case, in the speaker unit 103, the main internal component is only a speaker being a sounding body. Therefore, a speaker is arranged in the center between a right position and a left position, so that the weight balance on the right and left sides of the speaker unit is maintained.

The foregoing preferred embodiments are illustrative in all points and should not be construed to limit the present invention. The scope of the present invention is defined not by the foregoing preferred embodiment but by the following claims. Further, the scope of the present invention is intended to include all modifications within the scopes of the claims and within the meanings and scopes of equivalents.

What is claimed is:

1. A speaker unit mounting bracket comprising:

a base plate including mounting holes that accept fasteners that fix the base plate directly to a wall or ceiling;

a voltage converter mounted to the base plate;

a first connecting member connected to the base plate and rotatable about a first axis;

a second connecting member configured to mount a speaker unit and connected to the first connecting member, the second connecting member being rotatable about a second axis that is different from the first axis; and a cover that covers the voltage converter and the base plate.

2. The speaker unit mounting bracket according to claim 1, further comprising:

an impedance adjuster arranged on the base plate, wherein the cover covers the impedance adjuster and includes a hole for operating the impedance adjuster from outside.

3. An installation speaker comprising:

a speaker housing;

a mounting bracket comprising:

a base plate including mounting holes that accept fasteners that fix the base plate directly to a wall or ceiling;

a voltage converter mounted to the base plate;

a first connecting member connected to the base plate and rotatable about a first axis;

a second connecting member mounting the speaker housing and connected to the first connecting member, the second connecting member being rotatable about a second axis that is different from the first axis; and a cover that covers the voltage converter and the base plate.

4. The installation speaker according to claim 3, wherein:

the first connecting member comprises a first axis member that rotatably mounts the speaker housing in a right-left direction with respect to the mounting bracket; and the second connecting member comprises a second axis member that rotatably mounts the speaker housing in an up-down direction with respect to the mounting bracket.

5. The installation speaker according to claim 3, further comprising a speaker arranged in a center between a right position and a left position of the speaker housing.

* * * * *